United States Patent [19]

Allen

[11] 3,998,026

[45] Dec. 21, 1976

[54] TYING DEVICE FOR TYING WOODEN MEMBERS TO MASONRY AND CONCRETE STRUCTURES

[75] Inventor: George E. Allen, Dolton, Ill.

[73] Assignee: Allen Anchor Corporation, South Holland, Ill.

[22] Filed: June 3, 1976

[21] Appl. No.: 692,466

[52] U.S. Cl. ..... 52/714; 52/295; 52/370; 52/715

[51] Int. Cl.[2] ..... E04B 1/42

[58] Field of Search ..... 52/300, 37 D, 714, 715, 52/127, 295; 248/247–248, 300

[56] References Cited

UNITED STATES PATENTS

| | | | |
|---|---|---|---|
| 3,471,988 | 10/1969 | Allen | 52/300 |
| 3,750,360 | 8/1973 | Kingston | 52/369 X |
| 3,782,058 | 1/1974 | Allen | 52/562 X |
| 3,889,440 | 6/1975 | Sutter | 52/369 |
| 3,889,441 | 6/1975 | Fortine | 52/714 X |

*Primary Examiner*—Alfred C. Perham
*Attorney, Agent, or Firm*—Charles B. Cannon

[57] ABSTRACT

A tying device for tying wooden plate members, or the like, to masonry and concrete structures, including walls, floors, roofs, beams and foundations constructed of either masonry or concrete, the tying device being formed from a flat strip of bendable sheet metal stock, such as sheet metal, or the like having a part which provides an anchor portion for anchoring the tying member to a masonry or concrete structure and having another part which is slit lengthwise of the flat strip of metal stock to provide a pair of bendable tying arms which may be bent around the sides and over a portion of the top of a wooden plate member, or the like, to which the bendable tying arms may be attached by fastening means, such as nails. The tying device includes limiting or stop means for limiting the extent or degree to which the bendable tying arms may be spread relative to each other on opposite sides of the anchor portion and to assure proper positioning of the bendable tying arms relative to each other and relative to the wooden plate member or the like to which they are attached in use.

12 Claims, 26 Drawing Figures

TYING DEVICE FOR TYING WOODEN MEMBERS TO MASONRY AND CONCRETE STRUCTURES

BACKGROUND OF THE INVENTION

Tying devices for tying wooden plate members, or the like, to masonry and concrete walls, including concrete block walls, concrete walls, and the like, are well known in the art and are exemplified by applicant's earlier U.S. Pat. Nos. 3,471,988; 3,494,090; 3,729,882 and 3,702,058 and the references cited therein. Such prior tying devices are, in general, satisfactory. However, in the use of such prior tying devices applicant has found that the proper location of the bendable tying arms relative to each other and to the anchor portion of the tying device, and relative to the side walls and top wall of the wooden plate member, or the like, to which the bendable tying arms are attached, may in some instances present a problem in the use of such tying devices. The present invention is designed to overcome this problem by providing in the new tying device limiting or stop means for limiting and controlling the extent or degree of movement to which the bendable tying arms may be spread apart relative to each other on opposite sides of the anchor portion to assure proper positioning of the bendable tying arms relative to each other and relative to the anchor portion and the wooden plate member, or the like, to which the bendable tying arms are attached in use.

OBJECTS OF THE INVENTION

An object of the present invention is to provide a new and improved tying device for tying a wooden plate member, or the like, to a masonry or concrete structure, including walls, floors, roofs, beams and foundations, which embodies a novel construction which is formed from a single strip of flat sheet metal stock having one end portion which provides an anchor for anchoring the tying device to a masonry or concrete structure and having another end portion which is slit lengthwise of the strip of flat metal stock to provide a pair of bendable arms which extend on opposite sides of the anchor portion and are adapted to be bent around the sides and over the top of a wooden plate member, or the like, to which they are attached by suitable fastening means, such as nails; and which tying device includes limiting or stop means for limiting and controlling the extent or degree to which the bendable tying arms may be spread apart on opposite sides of the anchor portion to assure proper positioning of the bendable tying arms relative to each other and relative to the anchor portion and relative to the wooden plate member, or the like, to which they are attached in use.

An additional object of the present invention is to provide a new and improved tying device for tying a wooden plate member, or the like, to a masonry or concrete structure, and in which the limiting or stop means, hereinbefore referred to, is formed as an integral part of the strip of bendable sheet metal stock from which the new tying device is formed.

A further object of the invention is to provide a new and improved tying device for tying a wooden plate member, or the like, to a masonry or concrete structure, in which the limiting or stop means, hereinbefore referred to, is formed as a separate limiting or stop member which is adapted to be attached to the body of the new tying device for limiting and controlling the degree or extent to which the bendable tying arms may be bent or spread apart relative to each other and on opposite sides of the anchoring portion to assure proper positioning of the bendable tying arms relative to each other and relative to the anchor portions of the new tying device and relative to the wooden plate member, or the like, to which they are attached in use.

Other objects will appear hereinafter.

DESCRIPTION OF FIGURES IN THE DRAWINGS

FIG. 4 is a perspective view of the tying device illustrated in FIGS. 1, 2 and 3 showing the anchoring portion thereof embedded in a masonry or concrete structure, such as a wall, and showing the bendable tying arms and limiting or stop means prior to the attachment of the bendable tying arms to a wooden plate member, or the like;

FIG. 8 is perspective view similar to FIG. 4, but showing the tying device illustrated in FIGS. 5, 6 and 7 with the anchoring portion thereof embedded in a masonry or concrete structure, such as a wall, and showing the bendable tying arms and limiting or stop means prior to the attachment of the bendable tying arms to a wooden plate member, or the like;

FIG. 12 is a perspective view similar to FIGS. 4 and 8, but illustrating the tying device shown in FIGS. 9, 10 and 11 with the anchoring portion thereof embedded in a masonry or concrete structure, such as a wall, and showing the bendable tying arms and limiting or stop means prior to attachment of the bendable tying arms to a wooden plate member, or the like;

FIG. 16 is a perspective view, similar to FIGS. 4, 8 and 12, but illustrating the modification shown in FIGS. 13, 14 and 15 with the anchoring portion thereof anchored in a masonry or concrete structure, such as a wall, and with the bendable tying arms bent into position for attachment to a wooden plate member or the like;

Figure 22:
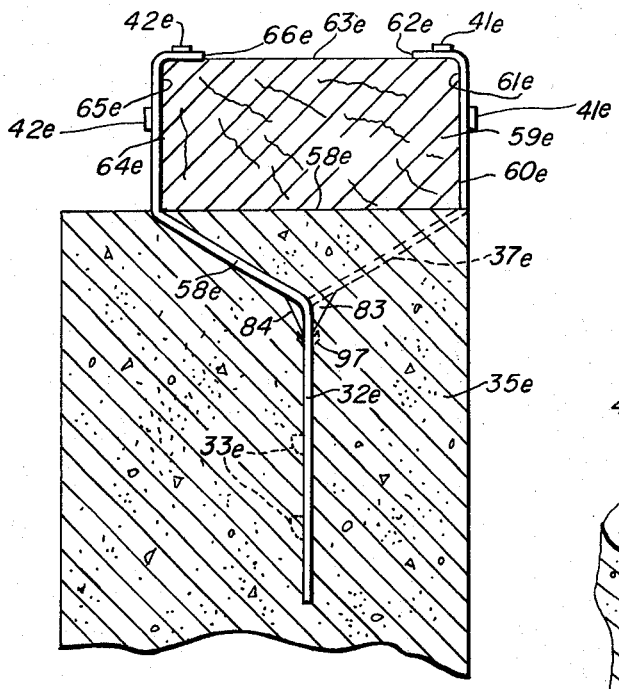
FIG. 22 is a sectional view, similar to FIGS. 1, 5, 9, 13 and 17, but illustrating a fifth modification of the invention in use.
Figure 23:
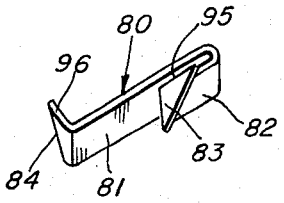
FIG. 23 is a perspective view of a limiting or stop member which is embodied in the modification illustrated in FIGS. 22, 24 and 25.
Figure 24:
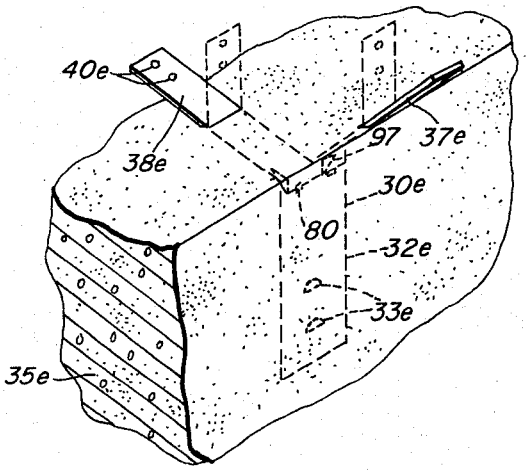
FIG. 24 is a perspective view, partly in section, illustrating the modification shown in FIG. 22 with the anchoring portion thereof embedded in a concrete structure, such as a wall, and with the bendable tying arms bent into position of use and showing the limiting or stop member attached thereto.
Figure 25:
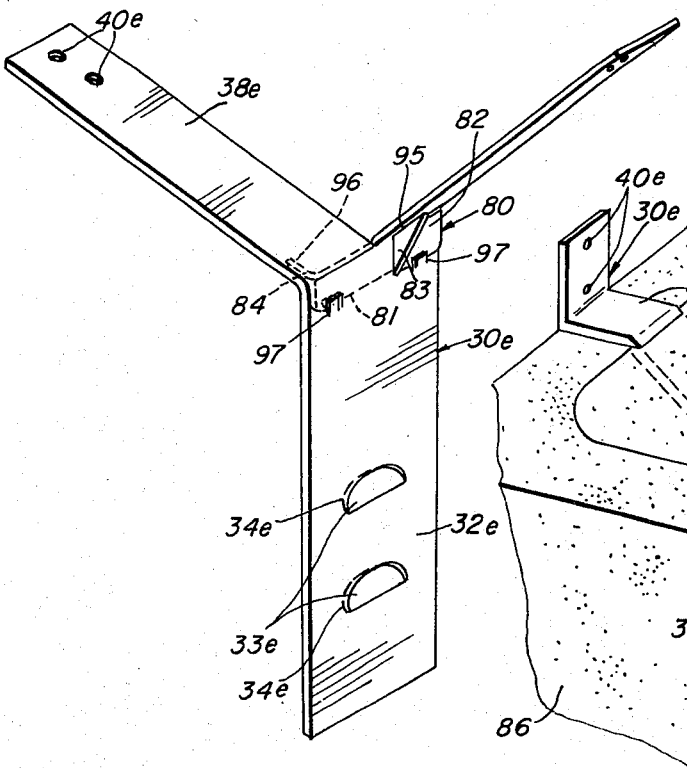
Figure 26:
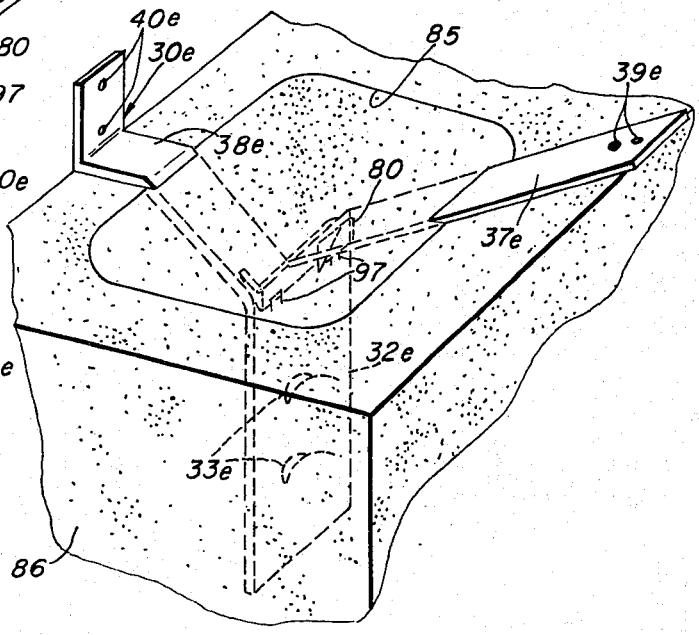

FIG. 25 is a perspective view of the modification illustrated in FIGS. 22, 23 and 24, but showing the bendable tying arms bent into position of use and showing the limiting or stop member shown in FIG. 23 attached to the tying device; and FIG. 26 is a perspective view illustrating the form of the invention shown in FIGS. 22, 23, 24 and 25 with the anchoring portion thereof embedded in a concrete block wall.

DESCRIPTION OF THE CONSRUCTION OF THE FORM OF THE INVENTION ILLUSTRATED IN FIGS. 1 to 4, INCLUSIVE, OF THE DRAWINGS

Figure 1:
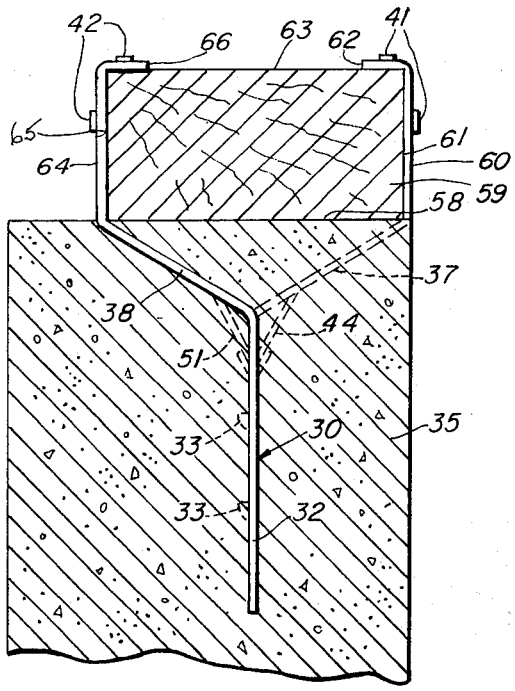
FIG. 1 is a sectional view illustrating a typical use of a preferred embodiment of the new tying device.

A preferred and typical embodiment of the invention is illustrated in FIGS. 1 to 4, inclusive, of the drawings, wherein it is generally indicated at 30, and is shown as being formed from a generally rectangular-shaped flat body or strip 31 of bendable sheet metal stock, such as sheet steel, or the like, which is cut, sized and shaped to provide the component parts of the new tying device illustrated in FIG. 1.

The new tying device 30 includes a lower end and anchoring portion 32 which has anchoring lugs 33 struck therefrom which form holes or apertures 34 in the anchoring portion 32, and as shown in FIG. 1, the anchoring portion 32 of the tying device 30 is shown as being embedded in a masonry or concrete structure, such as a wall 35.

Figure 2:
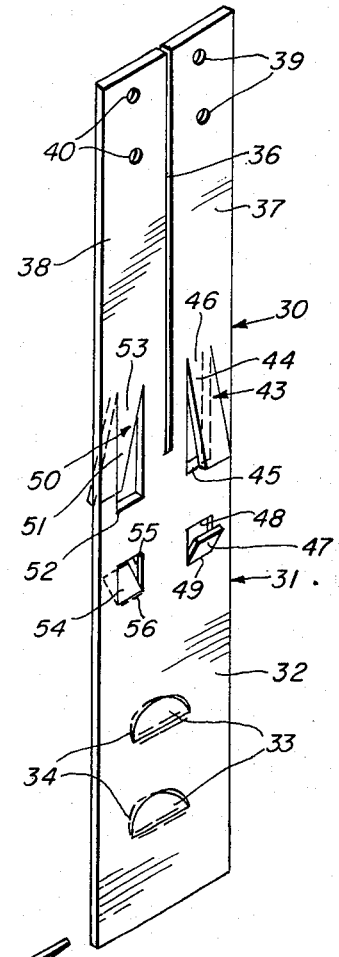
FIG. 2 is a perspective view of the new tying device illustrated in FIG. 1, as formed from a strip of flat metal stock prior to the bending of the bendable tying arms and the limiting or stop means.

As shown in FIG. 2, the end portion of the body or strip 31 which is opposite the anchoring end portion 32 is split lengthwise or longitudinally, as at 36, to provide a pair of bendable tying arms 37 and 38, which have holes, as 39 and 40, respectively, formed in the outer end portions thereof for the reception of fastening elements in the form of nails 41 and 42, respectively (FIG. 1), for fastening the new tying device 30 to a wooden plate member 59, or the like, as will be described more fully hereinafter.

Figure 3:
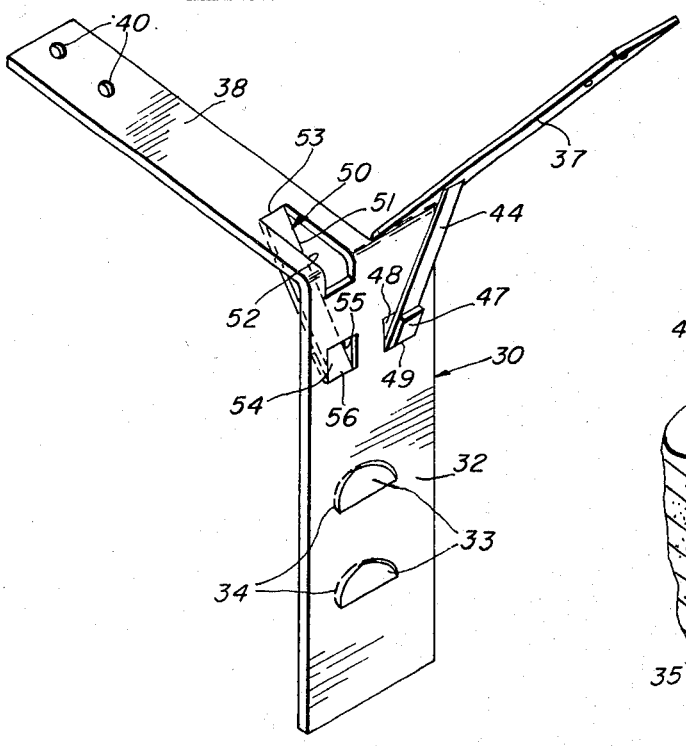
FIG. 3 is a perspective view of the tying device illustrated in FIGS. 1 and 2 with the bendable tying arms and limiting or stop means formed into position of use.
Figure 4:
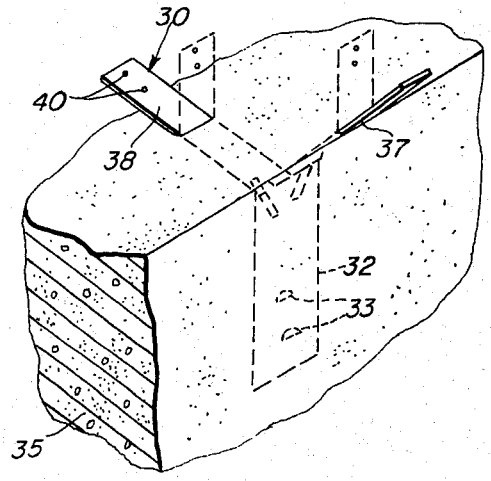

The new tying device 30 includes limiting or stop means for limiting and controlling the degree and extent to which each of the bendable tying arms 37 and 38 may be moved or spread apart relative to each other and relative to the anchoring portion 32 when the bendable tying arms 37 and 38 are bent out of coplanar relationship with the anchoring portion 32 and into position of use as in FIGS. 1, 3 and 4.

Thus, such limiting or stop means for the bendable tying arm 37 is generally indicated at 43 and includes a limiting or stop member 44 for the bendable tying arm 37 which is formed as a partially cut-out segment of the flat strip or body 31, thereby forming an opening 45 therein with the upper end portion of the limiting or stop member being hingedly and integrally connected to the body or strip 31 by a hinge portion 46 (FIG. 2) and in use extending angularly outwardly and downwardly from one side or face of the flat body or strip 31.

The limiting or stop means 43 for the bendable tying arm 37 includes a second stop member 47 which is formed as a partially struct-out portion 47 of the flat body or strip 31, thereby forming an opening 48 therein, with the lower end portion of the second limiting or stop member 47 being hingedly and integrally connected, as at 49, to the body or strip 31, and in use the second limiting or stop member 47 extends angularly outwardly and upwardly from the said side or face of the body or strip 31 as that from which the first stop member 44 projects, and below the latter (FIGS. 2 and 3).

Similarly, the new tying device 30 includes a second limiting or stop means, generally indicated at 50, for the bendable tying arm 38, and this second limiting or stop means 50 includes a limiting or stop member 51 which is formed as a partially cut-out segment of the body or strip 31, thereby forming an opening 52 in the body or strip 31, with the stop member 51 hingedly and integrally connected at its upper end, as at 53, to the body or strip 31.

The second or stop means 50 for the bendable tying arms 38 includes a second limiting or stop member 54 which is formed as a partially struck-out portion of the body or strip 31, thereby forming an opening 55 therein, with the lower end portion of the second limiting or stop member 54 being hingedly and integrally connected, as at 56, to the body or strip 31.

DESCRIPTION OF THE USE AND OPERATION OF THE FORM OF THE INVENTION ILLUSTRATED IN FIGS. 1 TO 4, INCLUSIVE, OF THE DRAWINGS

In the use and operation of the preferred and typical form of the invention illustrated in FIGS. 1 to 4, inclusive, of the drawings, the new tying device 30, being formed as shown and described, the bendable tying arm 37 is bent out of coplanar relationship with the anchor portion 32 into the angular position in which it is shown in FIG. 3, and the limiting or stop members 44 and 47 for the bendable tying arm 37 are also bent, along their hinge lines 46 and 53, respectively, out of coplanar relationship with the anchor portion 32 and into the angular position in which they are shown in FIG. 3, with the lower end portion of the limiting or stop member 44 projecting downwardly over the inner surface of the second stop member 47 and engaging the anchor portion 32 at the hinge connection 49 of the limiting or stop member 47.

Similarly, the other bendable tying arm 38 is bent out of coplanar relationship with the anchor portion 32 on the opposite side thereof from the bendable tying arm 37, and the limiting or stop members 51 and 54 for the bendable tying arm 38 are bent along their hinge lines 53 and 56, respectively, out of coplanar relationship with the anchor portion 32 and into angular positions in which they are shown in FIG. 3, with the lower end portion of the stop member 51 projecting downwardly over the inner surface of the stop member 54 and engaging the anchor portion 32 at the hinge connection 56.

When the parts of the new tying device 30 are thus formed and shaped as in FIG. 3, the tying device may be installed in a masonry or concrete structure, such as the concrete wall 35, with the anchoring portion 32 thereof extending vertically downwardly in the concrete or mortar 35 and being positioned and located therein, as illustrated in FIG. 1. When so disposed, the anchoring portion 32 is firmly anchored in the concrete or mortar by the material flowing around the anchoring lugs 33 and through the holes 34 in the anchoring portion 32. Likewise, the new tying device 30 is further anchored in the body of the concrete wall 35 by concrete flowing around the limiting or stop members 44–47 and through the openings 45 and 48 formed thereby, and by concrete flowing around the limiting or stop members 51 and 54 and through the openings 52 and 55 formed thereby in the body or strip 31.

When the new tying device 30 is thus anchored in concrete or mortar, as 35, (FIG. 1) the bendable tying arm 37 extends angularly upwardly and outwardly from the anchor portion 32 to the upper or top surface 58 of the concrete or masonry structure, such as the wall 35, on which the wooden plate or like member 59 is arranged, and the new tying device 30 is used to tie the wooden plate or like member 59 to the concrete wall 35. This is accomplished by bending a first portion 60 of the bendable tying arm 37 vertically upwardly along the outer wall surface 61 of the wooden plate member 59 and by bending a second and outer end portion 62 of the bendable tying arm over the top or upper wall surface 63 of the wooden plate member 59 and attaching the first portion 60 and the second or outer end portion 62 of the bendable tying arm 37 to the wooden plate member 59 by means of the fastening elements in the form of the nails 41 inserted through the openings 39 into the body of the wooden plate member 59 (FIG. 1).

Similarly, a first portion 64 of the bendable tying arm 38 is bent vertically upwardly along the outer wall surface 65 of the wooden plate member 59 and a second and outer end portion 66 of the bendable tying arm 38 is bent over the upper surface of the wooden plate member 59 and the first and second portions 64 and 66 of the bendable tying arm 38 are attached by the fastening elements in the form of the nails 42 inserted through the holes 40 into the body of the wooden plate member 59, thereby completing the tying of the wooden plate member 59 to the concrete wall 35.

DESCRIPTION OF THE FIRST MODIFICATION OF THE INVENTION ILLUSTRATED IN FIGS. 5 TO 8, INCLUSIVE, OF THE DRAWINGS

A first modification of the invention is illustrated in FIGS. 5 to 8, inclusive, of the drawings, and those parts thereof which are similar to or correspond to parts of the invention illustrated in FIGS. 1 to 4, inclusive, have been given the same reference numerals followed by the additional and distinguishing reference character *a*.

Figure 5:
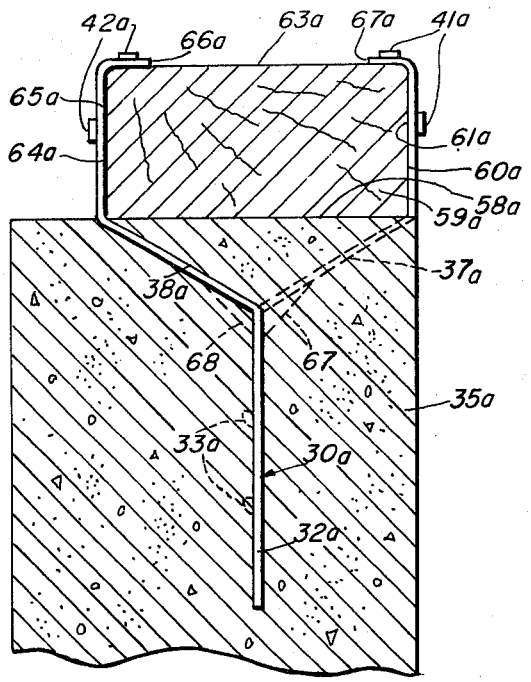
FIG. 5 is a sectional view similar to FIG. 1, but illustrating a first modification of the invention.
Figure 6:
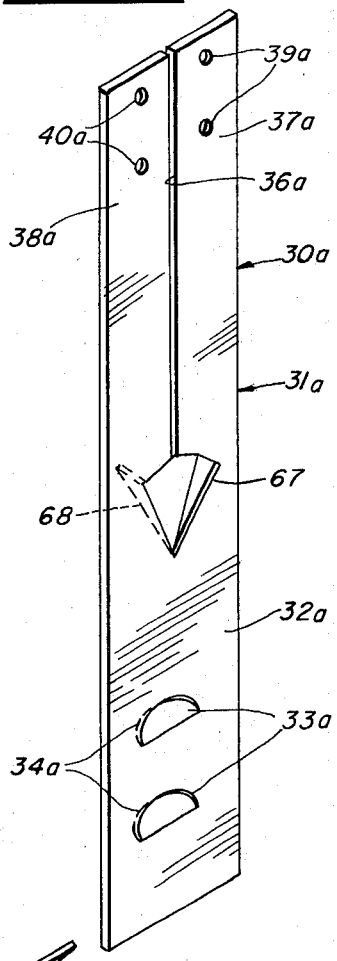
FIG. 6 is a perspective view, similar to FIG. 2, but illustrating the tying device shown in FIG. 5, as formed from a strip of flat metal stock, prior to bending of the bendable tying arms and limiting or stop means.
Figure 7:
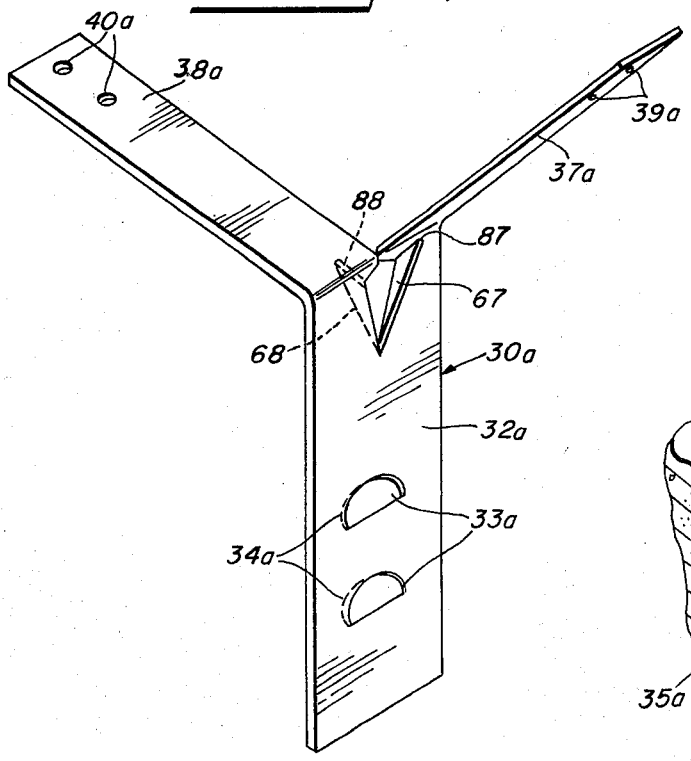
FIG. 7 is a perspective view of the tying device illustrated in FIGS. 5 and 6 but illustrating the bendable tying arms and limiting or stop means bent into position for installation and use.
Figure 8:
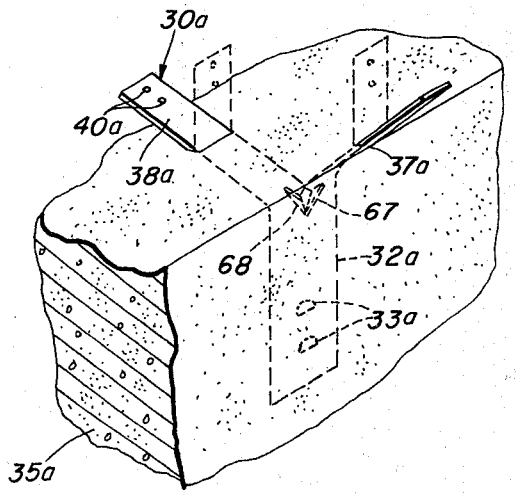

The modified form of the invention illustrated in FIGS. 5 to 8, inclusive, is substantially the same as the form of the invention illustrated in FIGS. 1 to 4, inclusive, but differs therefrom in the form and construction of the limiting or stop means which, in this modification, consists of two generally triangular shaped stop members 67 and 68 which are partially struck out of the upper end portion of the anchor portion **32*a* and project laterally from opposite sides thereof so that in use the bendable tying arms 37*a* and 38*a* bear on the upper edge portions 87 and 88 of the stop members 67 and 68, respectively, as illustrated in FIG. 5 and 7 of the drawings, thereby limiting the extent to which the bendable tying arms 37*a* and 38*a* may be bent outwardly relative to the anchor portion 32*a*** and relative to each other.

DESCRIPTION OF THE SECOND MODIFICATION OF THE INVENTION ILLUSTRATED IN FIGS. 9 TO 12, INCLUSIVE, OF THE DRAWINGS

A second modification of the invention is illustrated in FIGS. 9 to 12, inclusive, of the drawings, and those parts thereof which are similar to and correspond to parts of the invention illustrated in FIGS. 1 to 4, inclusive, have been given the same reference numerals followed by the additional and distinguishing reference character *b*.

Figure 9:
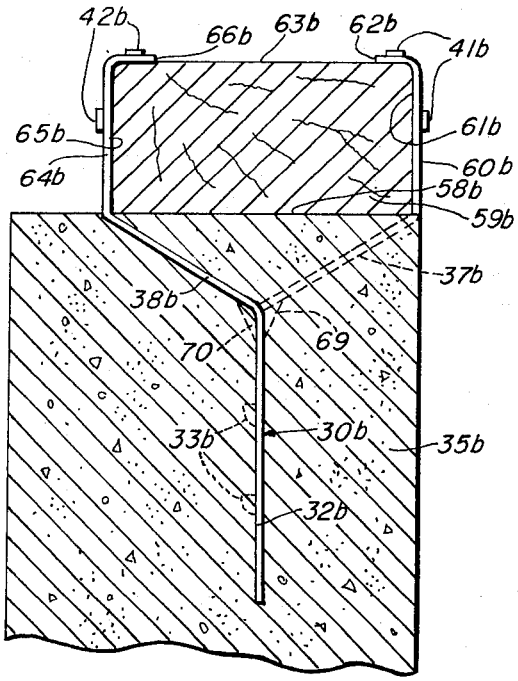
FIG. 9 is a sectional view similar to FIGS. 1 and 5, but illustrating a second modification of the new tying device as applied in use.
Figure 10:
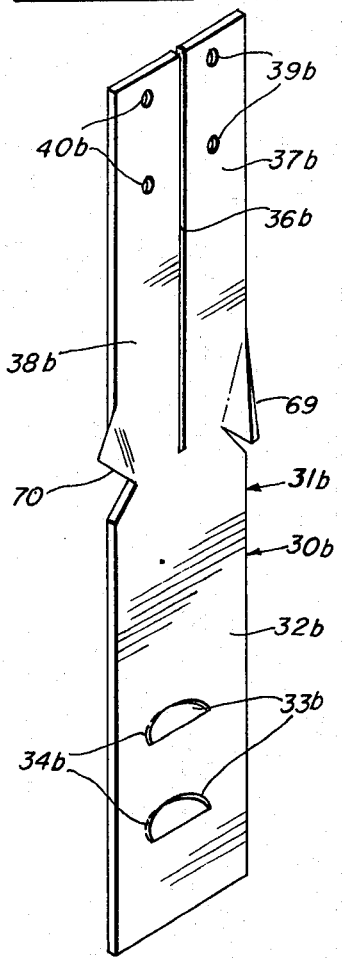
FIG. 10 is a perspective view similar to FIGS. 2 and 6, but illustrating the tying device shown in FIG. 9, as formed from a strip of flat metal stock, prior to bending of the bendable tying arms and limiting or stop means.
Figure 11:
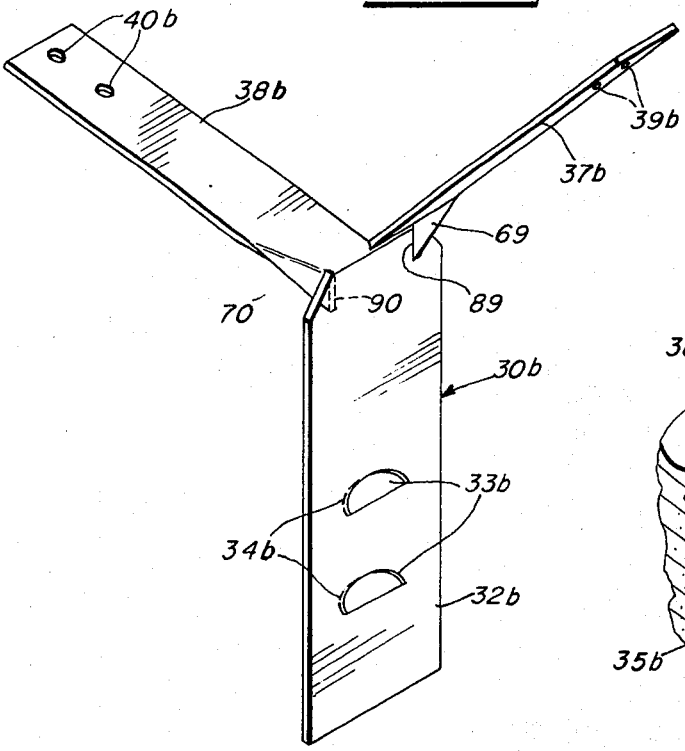
FIG. 11 is a perspective view similar to FIGS. 3 and 7, but illustrating the tying device shown in FIGS. 9 and 10 with the bendable tying arms and limiting or stop means formed into position of use.
Figure 12:
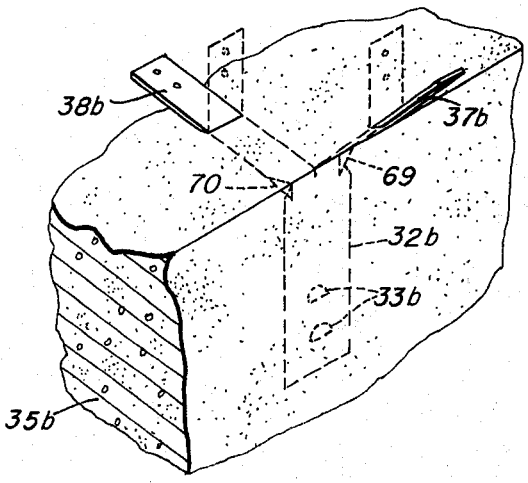

The modified form of the invention illustrated in FIGS. 9 to 12, inclusive, is substantially the same as the form of the invention illustrated in FIGS. 1 to 4, inclusive, but differs therefrom in the construction of the stop means, which in this form of the invention, consists of two generally triangular shaped stop members 69 and 70 which are partially struck out and bent downwardly from the inner end edge portions 89 and 90 of the bendable tying arms **37*b* and 38*b*, respectively, so that in use the vertically extending inner end portions 89 and 90 of the limiting or stop members 69 and 70, respectively, engage the upper end portion of the anchor portion 30*b*, on opposite sides thereof, as shown in FIGS. 9 and 11 of the drawings, thereby limiting the extent or degree of outward movement of the bendable tying arms 37*b* and 38*b*, relative to the anchor portion 30*b*** and relative to each other.

DESCRIPTION OF THE FORM OF THE INVENTION ILLUSTRATED IN FIGS. 13 TO 16, INCLUSIVE

A third modification of the invention is illustrated in FIGS. 13 to 16, inclusive, of the drawings, and those parts thereof which are similar to or correspond to parts in the form of the invention shown in FIGS. 1 to 4, inclusive, have been given the same reference numerals followed by the additional and distinguishing reference character *c*.

The modified form of the invention illustrated in FIGS. 13 to 16, inclusive, is substantially the same as the form illustrated in FIGS. 1 to 4, inclusive, but differs therefrom in the construction of the limiting or stop members 71 and 72 which are generally prismatic in form and each of which includes a face 91 or 92, respectively, which is welded or otherwise secured to the upper portion of the anchor portion 32*c* on the opposite sides thereof. Each of the limiting or stop members 71 and 72 has an angularly extending upper surface 93 and 94, respectively.

Figure 13:
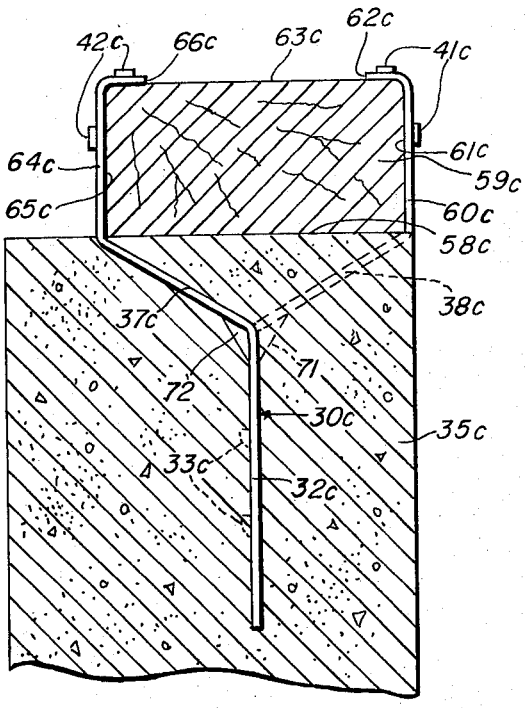
FIG. 13 is a sectional view, similar to FIGS. 1, 5 and 9, but illustrating a third modification of the invention as applied in use.
Figure 14:
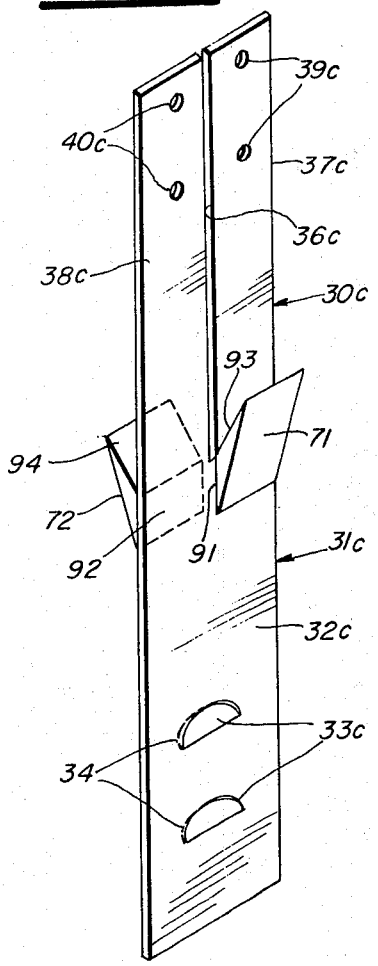
FIG. 14 is a perspective view of the modification illustrated in FIG. 13, as formed from a strip of flat metal stock, but prior to bending of the bendable tying arms and limiting or stop means.
Figure 15:
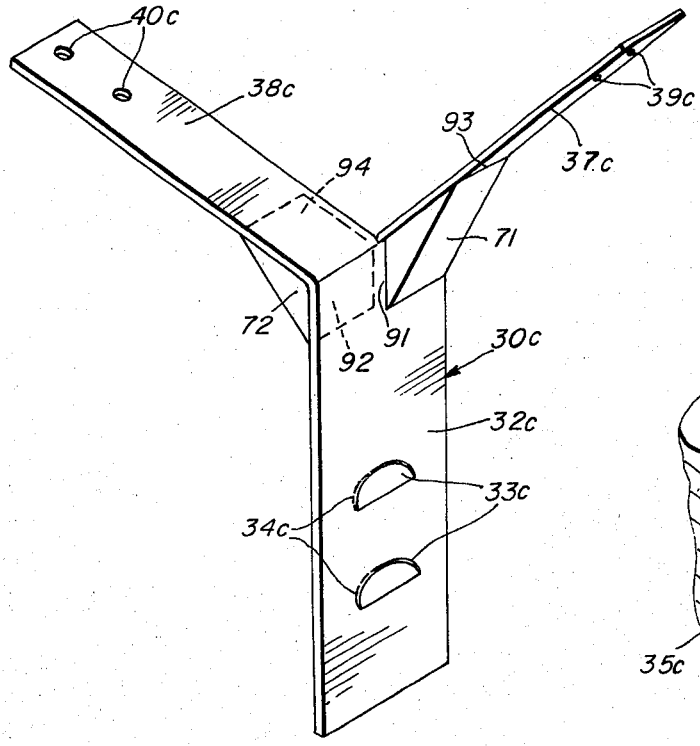
FIG. 15 is a perspective view, similar to FIGS. 3, 7 and 11, but illustrating the modification shown in FIGS. 13 and 14 with the bendable tying arms and limiting or stop means bent into position for use.
Figure 16:
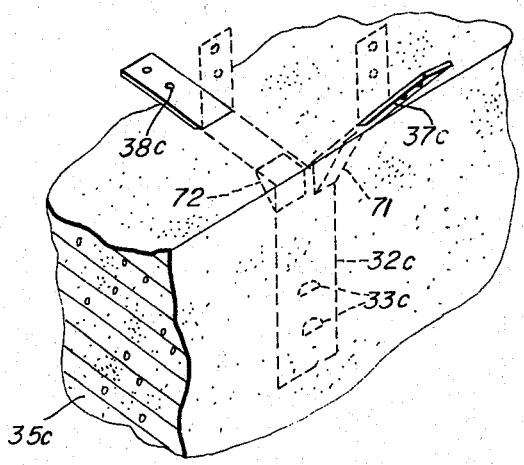

In the use of the form of the tying device shown in FIGS. 13 to 16, inclusive, when the bendable tying arms 37*c* and 38*c* are bent into position of use, as in FIGS. 13, 15 and 16, they engage and rest upon the angularly extending upper surfaces 93 and 94 of the limiting or stop members 71 and 72, respectively, thereby limiting the extent of the outward movement of the bendable tying arms 37*c* and 38*c* relative to the anchor portion 32*c* and relative to each other.

DESCRIPTION OF THE MODIFICATION OF THE INVENTION ILLUSTRATED IN FIGS. 17 TO 21, INCLUSIVE, OF THE DRAWINGS

A fourth modification of the invention is illustrated in FIGS. 17 to 21, inclusive, of the drawings, and those parts thereof which are similar to or correspond to parts of the invention illustrated in FIGS. 1 to 4, inclusive, have been given the same reference numerals followed by the additional and distinguishing reference character *d*.

The modification of the invention illustrated in FIGS. 17 to 21, inclusive, of the drawings, differs from the form of the invention illustrated in FIGS. 1 to 4, inclusive, in the construction and use of the limiting or stop means which in this form of the invention consists of a limiting or stop member 73 which is formed as a separate unit relative to the flat strip or body 31*d* and includes one end portion 74 which has a laterally extending arm 75 at the end thereof which is provided with a slot 76. The limiting or stop member 73 includes a second end portion 77 which has a laterally extending arm 78 at the end thereof provided with a slot 79, the arms 75 and 78 extending in opposite directions on and relative to the end or body portions 74 and 77, respectively, of the limiting or stop member 73.

Figure 17:
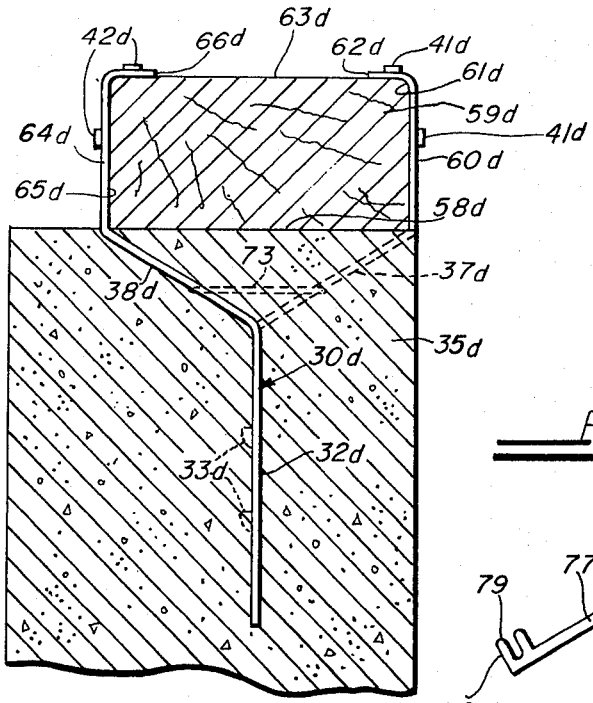
FIG. 17 is a sectional view, similar to FIGS. 1, 5, 9 and 13, but illustrating a fourth modification of the invention as applied in use.
Figure 18:
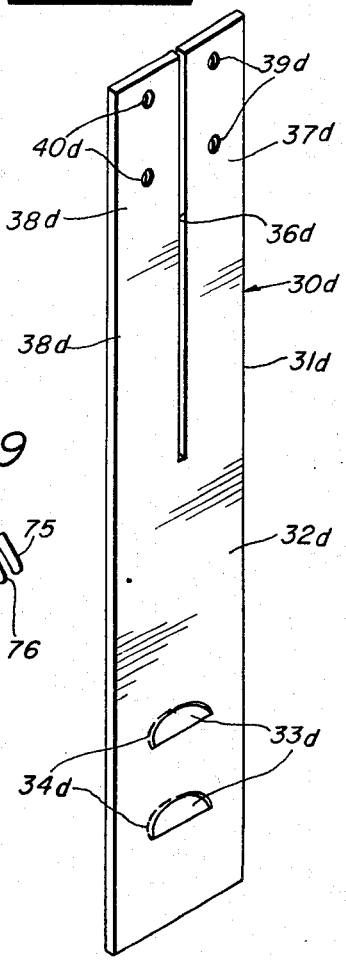
FIG. 18 is a perspective view, similar to FIGS. 2, 6, 10 and 14, but illustrating a strip of flat metal stock from which the bendable tying arms and anchor portion are formed, but prior to bending of the bendable tying arms.
Figure 19:
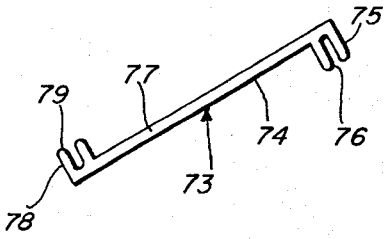
FIG. 19 is a perspective view of a limiting or stop member which is embodied in the form of the invention illustrated in FIGS. 17, 18, 20 and 21.
Figure 20:
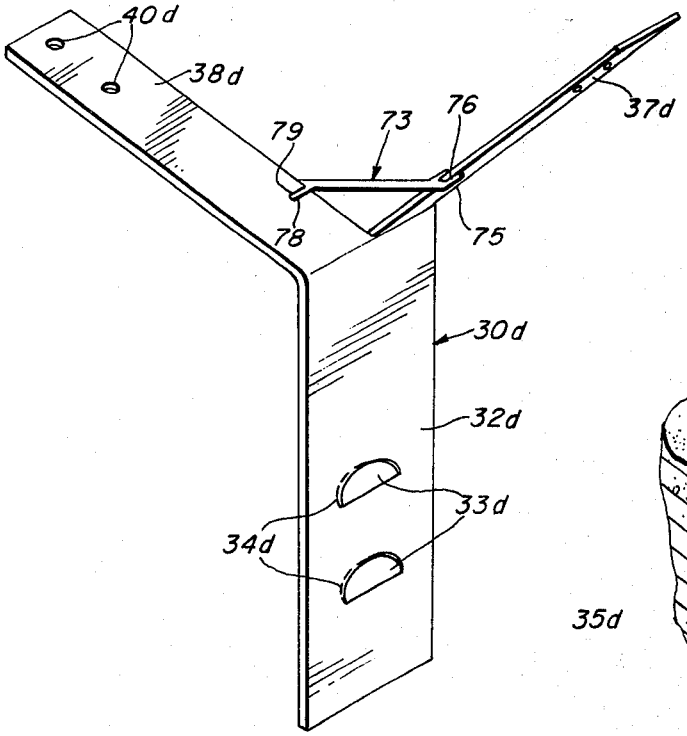
FIG. 20 is a perspective view of the modification illustrated in FIGS. 17, 18 and 19 and showing the bendable tying arms bent into position for use and showing the limiting or stop member of FIG. 19 attached thereto.
Figure 21:
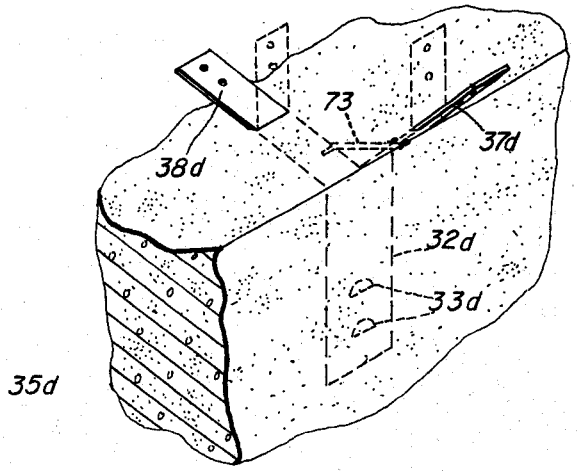
FIG. 21 is a perspective view, similar to FIGS. 4, 8, 12 and 16, but showing the form of the invention illustrated in FIGS. 17 and 20, inclusive, with the anchoring portion of the device embedded in a masonry or concrete structure, such as a wall, and with the bendable tying arms bent into position of use and showing the limiting or stop member attached thereto.

In the use of the modification of the invention illustrated in FIGS. 17 to 21, inclusive, the bendable tying arms 37*d* and 38*d* are bent into the desired position, as in FIGS. 17 and 20, whereupon the limiting or stop member 73 is manually inserted between the bendable tying arms 37*d* and 38*d* with the inner edge portion of the bendable tying arm 37*d* engaging in the slot 76 and with the inner edge portion of the bendable tying arm 38*d* engaging in the slot 39*d*, as shown in FIGS. 17 and 20, thereby maintaining the bendable tying arms 37*d* and 38*d* in proper angular relationship relative to the anchor portion 32*d* and relative to each other, as shown in FIGS. 17 and 20 of the drawings.

DESCRIPTION OF THE FORM OF THE INVENTION ILLUSTRATED IN FIGS. 22 TO 26, INCLUSIVE

A fifth modification of the invention is illustrated in FIGS. 22 to 26, inclusive, of the drawings, and those parts thereof which are similar to or correspond to parts of the invention illustrated in FIGS. 1 to 4, inclusive, have been given the same reference numerals followed by the additional and distinguishing reference character *e*.

The form of the invention illustrated in FIGS. 22 to 26, inclusive, differs from the form of the invention illustrated in FIGS. 1 to 4, inclusive, in that in this form of the invention the limiting to stop means consists of a separate stop member 80 which is shown in FIG. 23, which is formed from a flat strip of bendable resilient sheet metal stock, and includes a body portion 81 having one end portion 82 bent back on the body portion 83 and provided with a generally triangular-shaped limiting or stop portion 83 which projects laterally and generally rightangularly outwardly from the body portion 81. In addition, the body portion 81 has a second generally triangular-shaped limiting or stop portion 84 formed at the other end thereof and which projects laterally and generally rightangularly from the body portion 81.

It will be noted that the body 80 and the portion 82 of the limiting to stop member 80 cooperate to provide a clamping means for releasably clamping the limiting or stop member 80 on the upper end portion of the anchoring portion 32*e* and below the bendable tying arms 37*e* and 38*e*.

It will also be noted that the generally triangular-shaped limiting or stop portions 83 and 84 have upwardly angled upper edge portions 95 and 96, respectively, formed thereon.

In addition, the upper end portion of the anchoring portion 30*e* has laterally projecting supporting and guiding elements, in the form of partially struck-out tongues 97, formed thereon and projecting laterally from opposite sides thereof to provide supporting and guiding means for the limiting or stop member 80, as best shown in FIG. 25.

In the use of the modified form of the invention illustrated in FIGS. 22 to 26, inclusive, the limiting or stop member 80 is manually inserted into the upper end portion of the anchoring portion 30*e* above the laterally projecting supporting and guiding elements 97, with a portion of the anchoring portion 30*e* projecting between the body 81 and the clamping portion 82, and with the clamping means 81–82 thereby holding the limiting or stop member 80 in proper position of use on the upper end portion of the anchor portion 30*e* and below the bendable tying arms 37*e* and 38*e* and with the generally triangular-shaped limiting or stop members 83 and 84 projecting laterally and generally rightangularly from the anchor portion 32*e* on opposite sides thereof. When the limiting or stop member 80 is thus positioned, the bendable tying arms 37*e* and 38*e* engage the upwardly angled upper edge portions 95 and 96 of the generally triangular-shaped limiting or stop portions 83 and 84, respectively, thereby limiting the downward bending movement of the bendable tying arms 37*e* and 38*e* and positioning them in relationship relative to each other and relative to the anchoring portion 32*e*, as shown in FIGS. 22 and 25 of the drawings.

FIG. 26 of the drawings illustrated the form of the new tying device which is illustrated in FIGS. 22 to 25, inclusive, as being anchored within the cavity 85 of a concrete block 86 of a concrete block wall and with the bendable tying arms 37*f* and 38*f* projecting upwardly and outwardly therefrom and adapted to be fastened to a wooden plate member or the like.

It will thus be seen from the foregoing description, considered in conjunction with the accompanying drawings, that the present invention provides a new and improved tying device having the desirable advantages and characteristics and accomplishing its intended objects, including those hereinbefore pointed out and others which are inherent in the invention.

I claim:

1. A tying device for tying a wooden member which includes spaced side walls and spaced top and bottom walls to a surface of a masonry or concrete structure, comprising:

a. a tying member formed from a strip of bendable flat metal stock, cut, shaped and sized to provide
  1. a body including
    a. an anchor portion adapted to be anchored in a masonry or concrete structure;
    b. a pair of bendable tying arms having integral hinge connections to the said anchor portion and adapted to be bent along said hinge connections angularly outwardly and upwardly on opposite sides of the said anchor portion;

b. each of said bendable tying arms including
  1. a portion extending in use angularly outwardly and upwardly from the said anchor portion, and including
  2. angularly extending portions adapted in use to be bent upwardly over one of the said walls of the said wooden member and fastened to the said one wall of the said wooden member with the bottom wall of the said wooden member resting on the said surface of the said masonry or concrete structure;

c. the said tying device including
  1. limiting and stop means cooperating with the said anchor portion of the said body of the said tying device for limiting the outward bending movement of the said bendable tying arms and for positioning the said tying arms in a preselected angular position relative to each other and relative to the said anchor portion and an opposite sides thereof.

2. A tying device as defined in claim 1 in which each of the said bendable tying arms includes a. a main body portion; and in which the said limiting and stop means includes b. a tongue member partially struck out of the said body portion of each of the said bendable tying arms and each having an upper end portion hingedly connected to the said body portion of one of the said bendable tying arms for hinged movement outwardly and downwardly from the body portion of the said bendable tying arm on opposite sides thereof; and in which c. each of the said limiting and stop means includes
  1. a pair of limiting and stop members partially struck out of the said anchor portion on opposite sides thereof and each including
    a. a lower end portion having
      1. a hinge connection with the said anchor portion; and in which d. each of the said tongue members includes
  1. a lower end portion adapted to engage and bear against one of the said limiting and supporting members to limit the bending movement of the said bendable tying arms and to position the said bendable tying arms in a preselected angular position relative to the said anchor position and on opposite sides thereof and relative to each other.

3. A tying device as defined in claim 1 in which a. each of the said bendable tying arms includes
  1. a body having
    a. generally parallel upper and lower surfaces; and in which b. the said limiting and stop means includes
  1. a pair of limiting and stop members partially struck from the said anchor portion on opposite sides thereof and each having
    a. a hinged connection with the said anchor portion; and
    b. an upper edge portion; and in which the lower surface of the body of each of the said bendable tying arms is adapted in use to bear against the said upper edge portion of one of the said limiting and stop members to limit the bending movement of the said bendable tying arms and to position the said bendable tying arms in a preselected angular position relative to the said anchor portion of the said tying device and relative to each other.

4. A tying device as defined in claim 3 in which a. each of the said limiting and stop members is generally triangular in form and in which b. each of the said limiting and stop members includes
  1. a side edge portion forming the said hinged connection of the said limiting and stop member with the said anchor portion of the said tying device.

5. A tying device as defined in claim 1 in which a. each of the said bendable tying arms includes
  1. a body having
    a. generally parallel upper and lower surfaces; and in which b. the said anchor portion includes
  1. generally parallel side surfaces; and in which the said limiting and stop means includes
    a. a limiting and stop member partially struck from the body of each of the bendable arms and including
      1. an edge portion providing a hinged connection with the said body of the bendable tying arm; and
      2. a generally vertically extending inner edge portion adapted to bear against one of the said generally parallel side surfaces of the said anchor portion to limit the bending movement of the said bendable tying arms relative to the said anchor portion and to position the said bendable tying arms in a preselected angular position relative to the said anchor portion and relative to each other.

6. A tying device as defined in claim 5 in which a. each of the said limiting and stop members is formed as a generally triangular-shaped downwardly extending portion of one of the said bendable tying arms and includes 1. an upper edge portion providing the said hinged connection with one of the said tying arms.

7. A tying device as defined in claim 1 in which
a. the said anchor portion includes
1. generally parallel side surfaces; and in which
b. each of the said bendable tying arms includes
1. a body having
a. generally parallel upper and lower surfaces; and in which the said limiting and stop means includes
1. a limiting and stop member including a body attached to and projecting laterally from one of the said generally parallel side surfaces of the said anchor portion; and in which each of the said limiting and stop members includes
2. an angularly extending upper surface extending angularly upwardly from one of the said generally parallel side surfaces of the said anchor portion; and in which
b. the body of each of the said bendable tying arms is adapted in use to engage and bear against the angularly upwardly extending upper surface of one of the said limiting and stop members to limit the bending movement of the said bendable tying arms outwardly from the body of the said anchor portion on opposite sides thereof and to position the said bendable tying arms in a preselected angular position relative to the said body of the said anchor portion and relative to each other.

8. A tying device as defined in claim 7 in which
a. each of the said limiting and stop members is generally prismatic in form and includes a lower edge surface attached to the said body of the said anchor portion on one of the said side surfaces thereof.

9. A tying device as defined in claim 1 in which each of the said bendable tying arms includes
a. inner and outer edge portions; and in which the said limiting and stop means includes
b. a limiting and stop member including
1. a body including
a. spaced end portions projecting laterally from opposite sides of the said body and each having
1. a slot formed therein; and in which
c. the said limiting and stop member is adapted in use to extend between the said inner side edge portions of the said bendable tying arms with a portion of each of the said generally inner side edge portions of the said bendable tying arms projecting into each of the said slots to limit the bending movement of the said bendable tying arms and to position the said bendable tying arms in a preselected angular position relative to the said anchor portion and relative to each other.

10. A tying device as defined in claim 1 in which
a. the said anchor portion includes
1. a body having
a. an upper end portion; and
b. generally parallel side surfaces; and in which
b. each of the said bendable tying arms includes
1. a body having
a. generally parallel top and bottom surfaces; and in which
c. the said limiting and stop means includes
1. a limiting and stop member including
a. a body having
1. a clamping portion bent back upon the said body to provide therewith clamping means for releasably clamping the said limiting and stop member upon the said upper end portion of the said anchor portion below the said bendable tying arms; and in which
2. the said limiting and stop member includes
a. a first end portion extending laterally from the said clamping portion at one side of the said anchor portion and below one of the said bendable tying arms; and
b. a second end portion extending laterally from the said limiting and stop member at the other side of the said anchor portion and below the other one of the said bendable tying arms; and in which
d. the bottom surfaces of the said bendable tying arms are adapted to bear against the said end portions of the said limiting and stop member to limit the bending movement of the said bendable tying arms and to position the said bendable tying arms in preselected angular position relative to the said anchor position and relative to each other.

11. A tying device as defined in claim 1 in which each of the said bendable tying arms includes
a. inner edge portions; and in which the said limiting and stop means includes
b. a limiting and stop memeber removably mounted on the said bendable tying arms and engaging the said inner edge portions thereof.

12. A tying device as defined in claim 10 in which
a. the said upper end portion of the said anchor portion has laterally projecting supporting and guiding elements formed therein; and in which
b. the said limiting and stop member is adapted to rest upon and to be guided and supported by the said laterally projecting supporting and guiding elements.

* * * * *